US009470053B2

(12) United States Patent
Vestavik

(10) Patent No.: US 9,470,053 B2
(45) Date of Patent: Oct. 18, 2016

(54) GRAVITY BASED FLUID TRAP

(75) Inventor: Ola Michael Vestavik, Eggesbones (NO)

(73) Assignee: REELWELL AS (NO)

( * ) Notice: Subject to any disclaimer, the term of this patent is extended or adjusted under 35 U.S.C. 154(b) by 206 days.

(21) Appl. No.: 13/978,120

(22) PCT Filed: Jan. 4, 2012

(86) PCT No.: PCT/EP2012/050081

§ 371 (c)(1),
(2), (4) Date: Jul. 14, 2013

(87) PCT Pub. No.: WO2012/095340

PCT Pub. Date: Jul. 19, 2012

(65) Prior Publication Data

US 2013/0284519 A1 Oct. 31, 2013

(30) Foreign Application Priority Data

Jan. 14, 2011 (NO) ..... 20110067

(51) Int. Cl.

| | |
|---|---|
| ***E21B 21/12*** | (2006.01) |
| ***E21B 17/18*** | (2006.01) |
| ***E21B 21/00*** | (2006.01) |
| ***E21B 21/08*** | (2006.01) |

(52) U.S. Cl.

CPC ..... *E21B 21/12* (2013.01); *E21B 17/18* (2013.01); *E21B 21/001* (2013.01); *E21B 21/08* (2013.01)

(58) Field of Classification Search

CPC ..... E21B 17/18; E21B 17/203; E21B 21/12; E21B 21/002

See application file for complete search history.

(56) References Cited

U.S. PATENT DOCUMENTS

| | | | | |
|---|---|---|---|---|
| 2,951,680 | A | 9/1960 | Camp et al. | |
| 3,268,017 | A | 8/1966 | Yarbrough | |
| 5,586,609 | A * | 12/1996 | Schuh | 175/65 |
| 5,964,294 | A | 10/1999 | Edwards et al. | |
| 9,187,968 | B2 | 11/2015 | Hole et al. | |
| 2002/0007968 | A1 | 1/2002 | Gardes | |

(Continued)

FOREIGN PATENT DOCUMENTS

| | | | |
|---|---|---|---|
| WO | 2004018827 | A1 | 3/2004 |
| WO | 2004018828 | A1 | 3/2004 |
| WO | 2010039043 | A1 | 4/2010 |

OTHER PUBLICATIONS

Norwegian search report from Norwegian patent application No. 20110067, Aug. 13, 2011.

International Search Report from PCT/EP2012/050081, issued Jun. 4, 2013.

*Primary Examiner* — David Andrews
*Assistant Examiner* — Tara Schimpf
(74) *Attorney, Agent, or Firm* — Adenike Adebiyi

(57) ABSTRACT

A method to be used when performing drilling in a well bore and a device for performing the method are disclosed. The method includes positioning in the well bore a drill string comprising at least two pipe conduits, an upper end, and a lower end comprising a drilling tool, thereby forming an outer annulus between the well bore wall and the drill string. A well bore section comprising at least one u-shaped section is drilled. A first fluid with a first density is fed into the outer annulus above the u-shaped section, and a second fluid with a second density is provided within the drill string and around the tool, where the first density is larger than the second density.

7 Claims, 1 Drawing Sheet

(56) References Cited

U.S. PATENT DOCUMENTS

2004/0007351 A1* 1/2004 Zupanick ..... E21B 7/046 166/50
2004/0104052 A1 6/2004 Livingstone
2005/0103527 A1* 5/2005 Church ..... E21B 7/068 175/62
2006/0124360 A1 6/2006 Lee
2013/0087389 A1* 4/2013 Hole et al. ..... 175/65

* cited by examiner

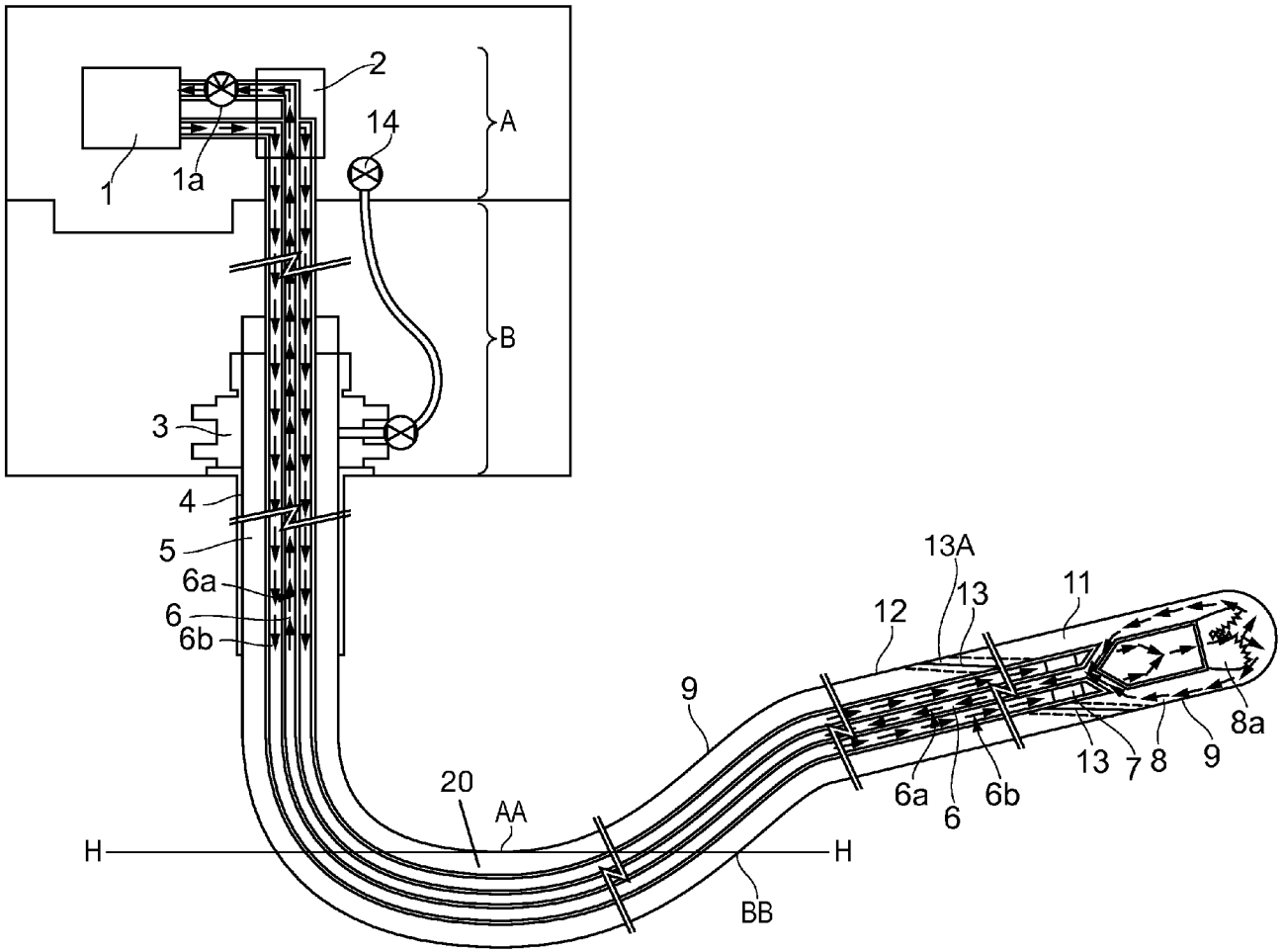
A
B
1
1a
2
14
3
4
5
6a
6
6b
9
12
13A
13
11
13
7
8
9
8a
20
AA
BB
H
H

GRAVITY BASED FLUID TRAP

FIELD

The present invention regards a method and device for performing drilling activities in a well.

BACKGROUND

To extract petroleum fluids from a reservoir in an earth formation, wells are drilled into the earth formations. Wells can also be drilled into the earth to provide channels for fluid transport, cable guides, transportation means, tunnels, use of geothermal energy etc. For petroleum exploration and production, the development of drilling techniques has now evolved into the possibility of drilling wells in all directions to extract as much resources as possible out of a reservoir. A well may for instance comprise a mainly vertical section and at least one section which deviate from this vertical direction, possibly a mainly horizontal section. These sections of the well which deviate from a mainly vertical direction tend to become longer, and may extend for several thousand meters into a formation. The subsurface depth of the wells is also increasing and in addition wells are drilled at increasing water depths.

Drilling is normally performed by inserting a drilling bit on the end of a drill string into the well. The weight of the drill string is proportional with the length of the drill string. When drilling at large water depths the depth of the water also influences the pressure conditions in the well and the formation as such and adds to the weight of the drill string. During drilling one normally does not want formation fluid to penetrate into the well bore, so the pressure exerted by the drilling fluid on the formation should be higher than the formation pore pressure. Drilling equipment also includes the fluid contained between the drill string and the unlined formation wall. The drilling equipment provides control over the well during drilling and will therefore prevent blow outs. At the same time there is also a need to limit the amount of drilling fluid that penetrate the unlined formation wall, and also a need to prevent fracturing of the side wall of the drilled bore. Therefore the pressure exerted by the drilling equipment must not exceed a fracturing pressure of the formation. The formation pressure is also influenced by the hydrostatic pressure, and at larger water depths this also increases. When the pressure exerted by the drilling equipment moves towards the boundaries of the interval between the fracturing pressure and the formation pore pressure, the well needs to be provided with casings or liners before one may drill further in the well. This would often mean pulling the drilling equipment out of the well, and providing new sections of casing or liners in the well before one may continue with the drilling. There is therefore a general need to develop methods for performing drilling where the drilling for a longer period may be performed in the allowed pressure range, between the formation pore pressure and the formation fracturing pressure.

Another element is that when the well deviates from a vertical direction at least a part of the drill string will due to gravity forces also tend to come in contact with the wall of the bore hole. For a horizontal section the drill string will tend to rest on the relative lower part of the bore hole wall. This contact between the drill string and the bore hole wall will create friction as the drill string is moved further into the well during drilling or when it is moved out or into the well.

As wells are drilled at greater water depths and further into the ground and deviated well becomes longer, the weight of the drill string and friction forces increases. There will naturally be a limit to how much weight and friction forces the equipment for performing the drilling can withstand take and this will limit the reach of a conventional drilling string.

In US2004/0104052, and WO 2004/018828 there are described different methods for performing drilling with a dual bore pipe. There is in U.S. Pat. No. 5,964,294 described a tool for performing a down hole function in a horizontal or highly deviated well.

NO20100925 discloses a divider element and the use thereof for dividing the annulus on the outside of a dual pipe bore string into two different sections.

SUMMARY OF INVENTION

The drilling of inclined especially mainly horizontal wells has obtained increased attention in the recent years, and the near horizontal sections of the wells have increased. When drilling the last section with the longest distance from the well opening, any equipment in the tool area including dividers or pistons or similar devices increase the friction between the drill string and the wall of the well bore. A method applicable in these remote areas according to one or more embodiments of the present invention provides the advantages of the use of different fluids in the annulus without requiring the use of dividers, pistons or similar devices for keeping the fluids separate.

A method and device according to one or more embodiments of the present invention eliminates or at least reduces the drawbacks mentioned above in connection with conventional drilling.

A method and device according to one or more embodiments of the present invention limits the friction between the drill string and the walls of the well bore. A method and device according to one or more embodiments of the present invention increases the safety of the drilling operation especially by reducing the risk for penetration of formation fluid and blow outs.

In one aspect, the present invention regards a method to be used when performing drilling in a well bore. The method comprises positioning in the well bore a drill string comprising at least two pipe conduits, an upper end, and a lower end comprising a drilling tool. An outer annulus is formed between the well bore wall and the drill string. The method includes drilling a well bore section comprising at least one u-shaped section. The method includes feeding a first fluid with a first density into the outer annulus above the u-shaped section and providing a second fluid with a second density within the drill string and around the tool, where the first density is larger than the second density.

The combination of the u-shaped trajectory of the well bore and the difference in density between the two fluids results in the two fluids kept from being significantly mixed when the fluid interface is arranged down well of the u-shaped section.

The u-shaped section provides a local minimum in the well bore trajectory.

The method provides the possibility to provide the first fluid in the outer annulus with specific properties. Except for the density difference required to obtain that the first and second fluid are kept separate due to the u-shaped section and the force of gravity the properties of the second fluid within the drill string can be selected independently. The upper end of the drill string is positioned above the well bore and accessible from the entrance facility for the well bore onshore, the sea floor or on the sea surface.

The term "density" as applied here refers to the specific gravity of the fluid in question, a measurement of the specific gravity/density of a fluid can easily be obtained by a person skilled in the art.

The term "drill string" as used within this context refers to a string comprising at least two pipe conduits, which may be arranged as two parallel channels and or optionally as coaxial pipes. In one embodiment, the drill string is in the form of coiled tubing. Additionally, the drill string may comprise additional strings which may include electric or optical cables or other strings for communication or power transfer. The drill string may also comprise channels, pipes or strings not intended for circulation of fluids but for altering the weight of the drill string such as one or more gas filled strings.

The drilling of wellbores with near horizontal sections is well known; also directional drilling resulting in u-shaped sections is well known and may often occur unintentionally during drilling. However until now it has not been realized that such u-shaped sections form a fluid trap and that this gravity based trap can be utilized in the where disclosed advantages manner.

In one aspect of the method according to the invention, the method comprises circulating the second fluid within the drill string through the at least two pipe conduits in the drill string. Further the method may comprise circulating the second fluid into the well bore through a second inner annular space formed by a first of the at least two pipe conduits in the drill string, and out of the well bore through a central bore formed by the second of the at least two pipe conduits in the drill string.

In another aspect of the method according to the present invention the density of the fluids are such that the drill string is at least partly floating or buoyant in the first fluid in the outer annulus.

In one embodiment of the present invention the first fluid feed to the outer annulus is a kill mud. The properties of the kill mud are so that the weight of the mud is sufficient to suppress the flow of formation fluids into the well bore annulus.

According to one aspect of the present invention, the method comprises forming a fluid interface between the first fluid and the second fluid within the outer annulus above the tool and above an opening for circulating the second fluid into the second pipe conduit.

Further in one specific embodiment the method further comprises providing a third fluid 13A in the outer annulus 5 in the interface 13 between the first fluid and the second fluid, where the third fluid has a density in between the density of the first fluid and the density of the second fluid.

In one or more embodiments, the well bore below the at least one u-shaped section is an unlined well bore.

With this method one may provide the first fluid with specific properties adapted for the formation fracturing pressure and the formation pore pressure in the area where the well is to be drilled in the outer annulus.

By the present invention the possibility can also be achieved to drill wells in longer parts without the need to provide liners or casings in the well, as the pressure exerted from the drilling equipment on the formation may be specifically adapted to that part of the formation. With such a method there is also the possibility of providing the drill string with at least some buoyancy in the well in more horizontal sections and thereby limit the friction forces between the drill string and the well bore as will be explained below.

Additionally there is also the possibility to include additional u-shaped sections in the well bore and have different fluids in the outer annulus in the different areas down well of the different u-shaped sections, and thereby have the possibility of drilling even further without lining the well with casings or in deviated wells.

According to one aspect the method may comprise circulating the second fluid within the pipe through the two bores in the pipe. The pipe may also be another kind of pipe and the tool a different tool for performing another kind of activity in the well.

According to one aspect of the method the second fluid has a density which is less than a density of the first fluid. In this aspect, the densities of the fluids are such that the dual bore drill string is at least partly floating in the first fluid in the outer annulus. By having a lighter fluid within the drill string than outside the drill string, where this weight of the lighter fluid together with the weight of the dual bore drill string for a volume unit is less than the weight of the same volume unit of the first fluid positioned in the outer annulus, the drill string will, due to the principles of Archimedes, experience a buoyancy force as the dual bore drill string is submerged within the first fluid. This buoyancy force will reduce or eliminate friction forces between the dual bore drill string and the wall of the well bore as the dual bore drill string is moved along the well bore. As the friction forces during movement of the drill string are reduced, same equipment topside may then move a longer drill string, thereby extending the reach for performing deviated drilling. Also, the force from the weight of the dual bore drill string, hanging in a mainly vertical section of the well bore, and thereby also hanging off in equipment topside will be reduced due to buoyancy forces counteracting the gravitation forces, when the weight of a volume unit of dual bore drill string together with the second fluid is less than the weight of a volume unit of a fluid in the outer annulus in the vertical section of the well bore.

The present invention also regards a drilling device comprising a drill string comprising at least a first and a second pipe conduit, a tool attached at a lower end of the drill string, an outer annular space formed between the drill string and the wall of the well bore, supply means for providing a first fluid to the outer annular space, where the drill string and the tool is configured such that a second fluid is delivered down to the tool through the first pipe conduit in the drill string and returned to a upper end of the drill string from the tool, via a lower part of the annular space into at least one opening in the second pipe conduit and through the second pipe conduit. According to the invention the device further comprises a fluid interface between the first fluid and the second fluid in the annular space above the at least one opening into the second pipe conduit.

In the lower part of the outer annular space the second fluid is present whereas in a upper part of the annular space the first fluid is present. The device according to the present invention eliminates the need for a divider device as the fluids are generally kept separate buy their difference in density and the influence of gravity.

In one aspect of the present invention the drill string comprises an outer pipe and an inner pipe arranged to form an inner annular space between the outer pipe and the inner pipe, providing the first pipe conduit. Further the device may comprise supply means for proving a third fluid to the fluid interface between the first and the second fluid in the annular space.

In one embodiment of the device according to the present invention the first fluid is a kill mud. The properties of the kill mud are so that the weight of the mud is sufficient to suppress the flow of formation fluids into the well bore annulus.

According to an aspect the dual bore pipe may comprise an outer pipe and an inner pipe arranged to form an inner annular space between the outer pipe and the inner pipe.

The position of the fluid interface between the first and the second fluid is above the tool and the opening into the second pipe conduit. Thereby the first fluid is not introduced to the second pipe conduit when the u-shaped well bore has been established resulting in a fluid trap effect. The first fluid is in one embodiment feed into the outer annulus in the upper part of the well bore. Upper part should be understood to be close to the entry point of the well or the surface. In one aspect of the invention the first fluid fills the outer annulus from the upper part of the well and all the way down to the area just above the tool.

During drilling in one aspect of the invention the position of the fluid interface between the first and the second fluid is controlled and kept in the area close to the tool. Especially when the first fluid is a kill mud the inflow of formation fluids is thereby blocked through out the well bore except in the area surrounding the tool.

In one aspect is also the possibility of including third fluid in the fluid interface area between the first fluid and the second fluid. This may be of special interest in the case where the first fluid and the second fluid are different in density relatively easily mix when brought in contact. A third fluid would be selected having a density between the densities of the first and the second fluid and having a low miscibility with both the first and the second fluid.

Further in another embodiment of the present invention a fourth fluid with a density less than the density of the first fluid may be contained in parts of the outer annulus in the upper part of the wellbore up hole from the u-shape section. The reason for introducing this fourth fluid with less density than the first fluid in the upper part of the hole is to reduce or limit the well annulus pressure to stay in the accepted pressure range for the formation. Thus the first fluid may therefore be limited to only be filled in parts of the well annulus, and may be concentrated to the horizontal section where it is important to limit the friction between the drill string and the formation. The u-shaped section provides in a similar manner a fluid trap separating the fourth fluid from the first fluid by the action of gravity. A fluid interface between the fourth and the first fluid is formed in the annulus up hole from the u-shaped section.

Another reason for using a fourth low density fluid in parts of the vertical upper section of the well, is to increase the weight of the drill string. This will enable higher Weight On Bit capability and thereby faster penetration rates when drilling.

The first and the fourth fluid can be supplied into the outer annulus from the upper part of the wellbore. The first fluid can also be supplied into the outer annulus from the lower part of the wellbore by supplying the first fluid from the surface through one of the drill string channels.

The system and method of the present invention may be used with a riserless drilling system or with a drilling system with a marine riser.

BRIEF DESCRIPTION OF THE DRAWINGS

FIG. 1, the sole FIGURE, is a schematic of a riserless drilling system.

DETAILED DESCRIPTION

The invention will now be explained with an embodiment with reference to the attached drawing showing the principle of the invention.

FIG. 1 shows schematically a subsea well drilling, with a riserless system. Arrangements on a floater is schematically shown with reference A, the part of the equipment arranged in the water is schematically indicated with B and the part below B is in the ground for performing the drilling. On the floater there will be arranged fluid treatment and circulation system 1, providing a drilling fluid into a dual bore drill string 6, extending from above the water and down to the bottom hole assembly 8, comprising a drill bit 8*a*. On the floater there will also be arranged a top drive adapter 2, allowing the dual drill string 6 to be rotated while routing the fluid to the fluid treatment and circulation system 1.

There is on top of the well extending into the ground arranged a blow out preventer (BOP) 3. A casing 4 is installed in parts of the well, and extending partially into the ground. The casing may proceed to further down to the point AA or beyond that point. An outer annulus 5 is formed between the dual drill string 6 and the casing 4 or the wall 9 of the well bore below the casing 4.

There is through means 14 for providing a first fluid to the outer annulus 5. The first fluid is introduced to the outer annulus 5 in an upper section of the annulus, optionally via the BOP 3 as illustrated. The first fluid is provided as a barrier fluid in a first section 12 of the outer annulus 5. The means 14 comprises among other things a fluid line extending to the floater as indicated in the FIGURE. There is through the fluid treatment and circulation system 1 on the floater provided a second fluid within the dual drill string 6 down to a tool in the end of the drill string 6. The tool in this embodiment comprises the bottom hole assembly 8 with the drill bit 8*a* and a dual float valve 7. The valve 7 is arranged such that a fluid lead down in the well through a second annulus 6*b* formed between an outer and an inner pipe forming the dual drill string 6, is guided to a central flow through the drill bit 8*a* and from an annular flow around the drill bit 8*a*, and into a central bore 6*a* of the dual drill string 6 up to the floater. The second fluid fills an end section 11 of the outer annulus 5. The second fluid and the first fluid are in fluid contact at the fluid interface 13. The fluids are kept separate through gravity and a difference in density. The layout of the well bore includes at least one u-shaped part forming a gravity based fluid trap 20. The trap is recognized by the property that there exist at least one point BB further into the well than the point AA where the lowest point of the well bore at BB is equal to or higher than the than the horizontal plane H-H through the point AA. Due to this fluid lock and the forces of gravity the first fluid with a higher density blocks the first section 12 of the annulus from being filed with the second fluid. By adapting the first fluid in the lower/inner section of the well it is possible to drill longer passages of the well before liners and or casing 4 has to be installed in the well, as better control of the pressure exerted by the drilling equipment on the unlined wall of the well is achieved.

There is also the possibility of providing the drilling system with a riser extending between an upper end of the casing and up to a floater.

When utilizing the present invention at least one u-shaped section on the well bore must first be established. Accordingly in the initial phase until the first u-shape section has been established the first fluid in the outer annulus would need an additional physical barrier, for instance as disclosed in NO20100925, in order to have a significantly higher density than the density of the second fluid circulated within the drill string, if mixing of the fluids is to be avoided. However, as soon as the progress of the drilling has passed the point BB, the density as well as other properties of the first fluid can be changed without resulting in significant mixing of the two fluids.

In one embodiment the mixing of the two fluids in the initial phase is not considered problematic as the fluid treatment system 1 is fully capable of handling any of the first fluid that is mixed into the second fluid upon return. Therefore, a high density fluid may be utilized as the first fluid throughout the drilling process.

The invention has now been explained with reference to a non-limiting embodiment and a skilled person would understand that there may be made alterations and modifications to the embodiment with the alternatives indicated, that are within the scope of the invention as defined in the attached claims.

The invention claimed is:

1. A method to be used when performing drilling in a well bore, comprising:

positioning in the well bore a drill string comprising at least two pipe conduits, an upper end, and a lower end coupled to a drilling tool, thereby forming an outer annulus between the well bore wall and the drill string;

drilling at least one fluid trap in a section of the well bore;

feeding a first fluid with a first density into a portion of the outer annulus uphole of the fluid trap; and circulating a second fluid with a second density through the drill string and around the drilling tool;

wherein the first density is larger than the second density and a fluid interface is formed between the first fluid and the second fluid in a portion of the outer annulus downhole of the fluid trap;

wherein the first and second densities are selected such that a combined weight of the second fluid and the drill string for a volume unit is less than a weight of the first fluid for the same volume unit, allowing the drill string to be buoyant in the first fluid in the outer annulus.

2. The method according to claim 1, wherein circulating the second fluid through the drill string comprises circulating the second fluid through the at least two pipe conduits in the drill string.

3. The method according to claim 1, wherein circulating the second fluid through the drill string comprises circulating the second fluid into the well bore through an inner annular space formed by a first of the at least two pipe conduits in the drill string and out of the well bore through a central bore formed by the second of the at least two pipe conduits in the drill string.

4. The method according to claim 1, wherein the first fluid fed into the outer annulus is a kill mud.

5. The method according to claim 1, wherein the fluid interface between the first fluid and the second fluid within the outer annulus is formed uphole of the drilling tool and uphole of an opening for circulating the second fluid into the second pipe conduit.

6. The method according to claim 5, further comprising providing a third fluid in the outer annulus in the interface between the first fluid and the second fluid, where the third fluid has a density in between the density of the first fluid and the density of the second fluid.

7. The method according to claim 1, wherein the well bore below the fluid trap is an unlined well bore.

* * * * *